US005528478A

United States Patent [19]

Degelmann

[11] Patent Number: 5,528,478

[45] Date of Patent: Jun. 18, 1996

[54] LIGHTING FIXTURE HAVING A PARABOLIC LOUVER

[75] Inventor: Paul G. Degelmann, Americus, Ga.

[73] Assignee: Cooper Industries, Inc., Houston, Tex.

[21] Appl. No.: 539,073

[22] Filed: Oct. 4, 1995

[51] Int. Cl.[6] ..... F21V 11/06

[52] U.S. Cl. ..... 362/290; 362/291; 362/342

[58] Field of Search ..... 362/290, 291, 362/342

[56] References Cited

U.S. PATENT DOCUMENTS

| | | | |
|---|---|---|---|
| 3,591,798 | 7/1971 | Florence | 240/51.11 |
| 4,539,628 | 9/1985 | Bartenbach | 362/291 |
| 4,888,668 | 12/1989 | Roll | 362/342 |
| 5,029,059 | 7/1991 | Grimm | 362/342 |

OTHER PUBLICATIONS

ERCO Program 1991/93, Lighting brochure.
ParaLyte 848, Recessed Fluorescent Lighting brochure.
LIGHTOLIER, The Central Trough System.
Siemens, SiDeko, Mounted and Recessed Ceiling Luminaires with variable Lighting Technology, brochure.

*Primary Examiner*—Denise L. Gromada
*Assistant Examiner*—Alfred Basichas
*Attorney, Agent, or Firm*—Burns, Doane, Swecker & Mathis

[57] ABSTRACT

The lighting fixture according to the invention includes a fixture housing having a longitudinal axis and supporting a fluorescent lamp in the housing. Side reflectors are provided which extend parallel to the longitudinal axis of the housing on either side of the lamp. A plurality of cross vanes and two end vanes are positioned below and perpendicular to the longitudinal axis of the lamp. Each cross vane has a top surface of a generally V-shaped configuration and reflector surfaces extending from the top surface. The reflector surfaces are concavely curved with a radius of curvature which varies along the width of the cross vane. The end vanes also include a generally V-shaped top surface and one reflector surface with is concavely curved with a radius of curvature which varies along the width of the end vane. The cross vanes and end vanes according to the invention confine substantially all of the light to within the preferred RP-24 cut-off zone and prevent unnecessary reflections which lower efficiency.

21 Claims, 4 Drawing Sheets

LIGHTING FIXTURE HAVING A PARABOLIC LOUVER

BACKGROUND OF THE INVENTION

1. Field of the Invention

The present invention relates to overhead recessed, surface, and suspended lighting fixtures or luminaires used in direct or direct indirect lighting applications and in particular to a shielding media used in the luminaires.

2. Description of the Related Art

A conventional lighting fixture 10, as shown in FIG. 1, includes a metal housing accommodated in a conventional ceiling grid 12 in which one or more fluorescent lamps are mounted. One type of conventional lighting fixture also includes a shielding assembly mounted in the housing for directing the light emitted from the fluorescent lamps in a desired fashion. A known parabolic louver shielding assembly, as shown in FIGS. 1 and 2, includes longitudinal vanes 14 having curved reflecting surfaces and transversely extending cross vanes 16 also having curved reflecting surfaces.

The longitudinal vanes 14 and cross vanes 16 of the prior art louver assembly reflect light from the curved blades of the vanes 14,16 at an angle with respect to a vertical which is no greater than a cut off angle $\beta$. Therefore, the louver assembly creates a shielded zone which extends from the horizontal surface of the finished ceiling plane through an angle $\alpha$ and prevents light from being emitted or reflected from the fixture into the shielded zone.

The shielded zone defined by the angle $\alpha$ protects operators of visual display terminals by preventing the operator from viewing a reflection of a luminaire in the display terminal. Light which is emitted in the shielded zone which is defined by an angle Á of about 35 degrees has the greatest chance of reflecting off a display terminal into an operator's eyes, creating glare. Therefore, it is preferred that light be reduced or eliminated from a shielded zone of 35 degrees.

The Illuminating Engineering Society of North America has set forth recommended practices (RP-24) for lighting in offices containing computer visual display terminals. In accordance with RP-24 the preferred maximum luminances for direct lighting at 55, 65 and 75 cut off angles $\beta$, should be 850, 350 and 175 respectively measured in candelas per square meter.

As shown in FIG. 1, each of the cross vanes 16 of the known shielding assembly 12 extends from the reflecting surface of one longitudinal vane 14 to the reflecting surface of a neighboring longitudinal vane 14. The known cross vanes 16 have cross sectional shapes as shown in FIG. 2. The side reflective surfaces of the cross vane include two lower, curved reflecting surfaces 18 and two upper, planar reflecting surfaces 20. The lower reflecting surfaces 18 are defined by a constant radius of curvature which causes light rays L1 from a given point P on the lamp 22 to be directed downward into the room through an aperture of width A in the shielding assembly. However, the light rays L2 from the same point P on the lamp 22 which have deflected off the upper portion 20 of the reflective surface impinge against and reflect off the lower reflecting surface 18 of the opposite cross vane 16. As a result the light intensity of the rays L2 is reduced by the additional reflection. In addition, the reflected light L2 may be directed at an undesirable angle into the shielded zone.

In fact, light which is reflected off a highly specular reflecting surface such as the lower and upper reflecting surfaces 18,20, loses about fourteen percent of its intensity due to each reflection. Thus, the light which is reflected twice off two reflecting surfaces, such as the reflected light L2, loses fourteen percent of its efficiency in the first reflection and then an additional fourteen percent of its efficiency in the second reflection. Therefore, in order to achieve efficient illumination, it is desirable to minimize the number of surfaces from which the light reflects. In addition, it is desirable to prevent reflection of light into the shielded zone.

SUMMARY OF THE INVENTION

The present invention overcomes the deficiencies of the prior art cross vanes by reflecting the light from the fluorescent tube a minimum number of times, by confining substantially all of the light to within the preferred RP-24 cut-off zone and by virtually eliminating light in the shielded zone of 35 degrees.

According to one aspect of the present invention, the lighting fixture includes a housing having a longitudinal axis, means for supporting a fluorescent lamp in the housing and side reflectors extending parallel to the longitudinal axis of the housing. The side reflectors are positioned on either side of the lamp and a plurality of cross vanes are positioned below and perpendicular to the longitudinal axis of the lamp. Each cross vane has a top surface of a generally V-shaped configuration and reflector surfaces extending from the top surface. The reflector surfaces are concavely curved with a radius of curvature which varies along the width of the cross vane.

According to another aspect of the invention a cross vane is provided for directing light of a fluorescent lamp. The cross vane includes a top surface of a generally V-shape configured to accommodate a fluorescent light tube which extends perpendicular to a width of the cross vane and above the cross vane. The top surface includes legs extending from an apex of the top surface. The cross vane also includes two reflecting side surfaces, one of said side surfaces extending from a lower edge of each of the legs, the side surfaces being concavely curved along a width of the cross vane and having radii of curvature which vary along the width of the cross vane. The cross vane further includes means for attaching the cross vane to a fluorescent light fixture.

According to another aspect of the invention, an end vane is provided which includes a top surface of a generally V-shape which is configured to accommodate a fluorescent light. The end vane includes a reflecting side surface extending from the top surface. The reflecting side surface is concavely curved along the width of the end vane and has a radius of curvature which varies along the width of the end vane. The end vane also includes means for attaching the end vane to a fluorescent light fixture.

BRIEF DESCRIPTION OF THE DRAWING FIGURES

The invention will be described in greater detail with reference to the accompanying drawings in which like elements bear like reference numerals, and wherein.

DETAILED DESCRIPTION

Figure 7:
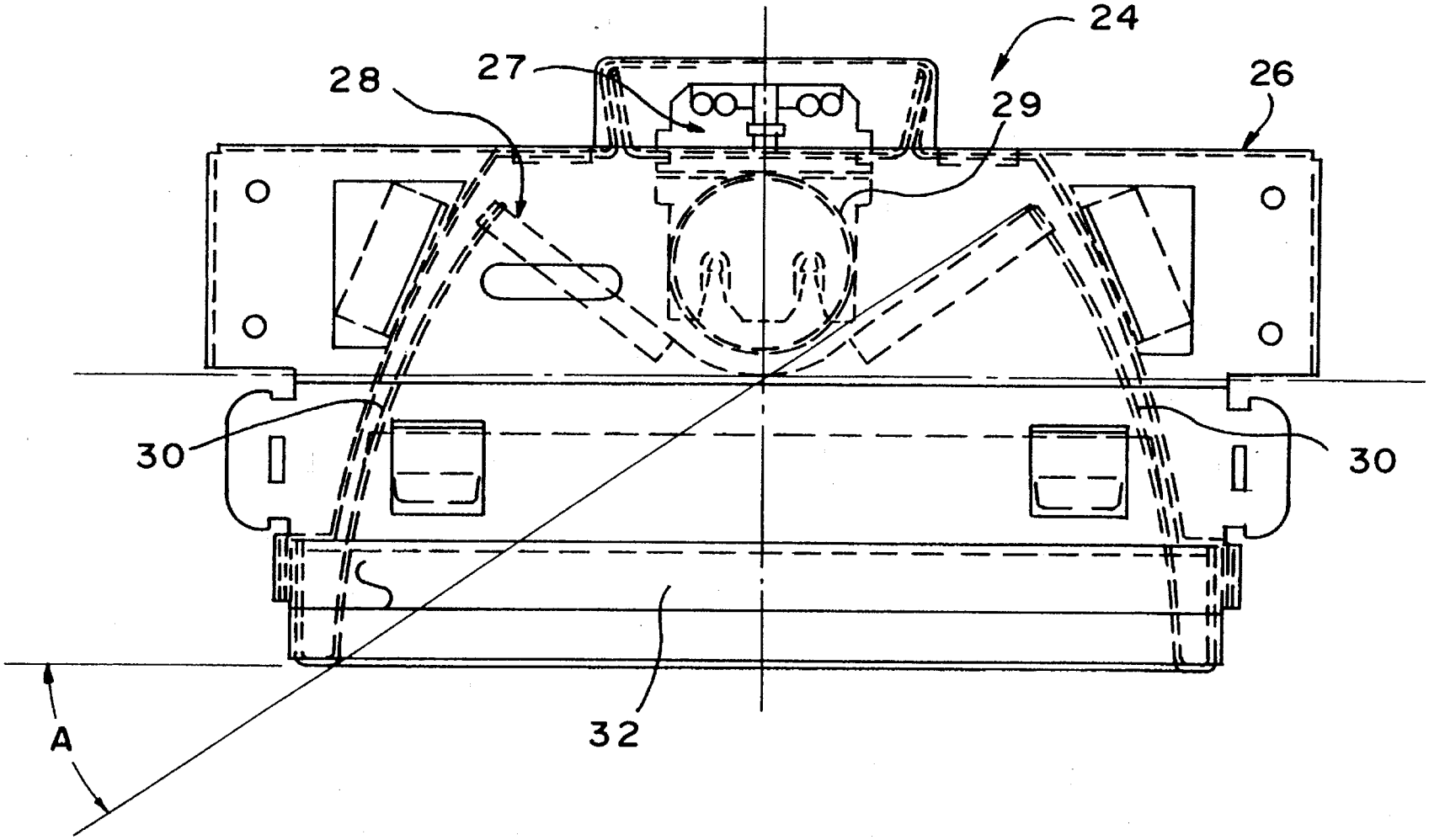
FIG. 7 is an end view of a fixture with a louver assembly according to the present invention mounted therein, with the louver assembly shown in hidden lines.

A lighting fixture according to the present invention is depicted in FIG. 7 which shows an end view of the fixture taken perpendicular to the axis of the florescent tube. The lighting fixture 24 includes a housing 26, an electrical connection 27, a fluorescent light tube 29 and a removable louver assembly 28 for directing the light from the fluorescent light tube 29 into the cut-off zone. The louver assembly 28 includes parabolic side reflectors 30 which extend along the length of the fixture within the housing. The side reflectors prevent light from being emitted into a shielded zone above a shielded angle A which is preferably about 35°. Cross vanes 32 and end vanes 34 extend perpendicular to the parabolic side reflectors and are connected to the side reflectors at regular intervals along the entire length of the fixture.

Figures 3, 4:
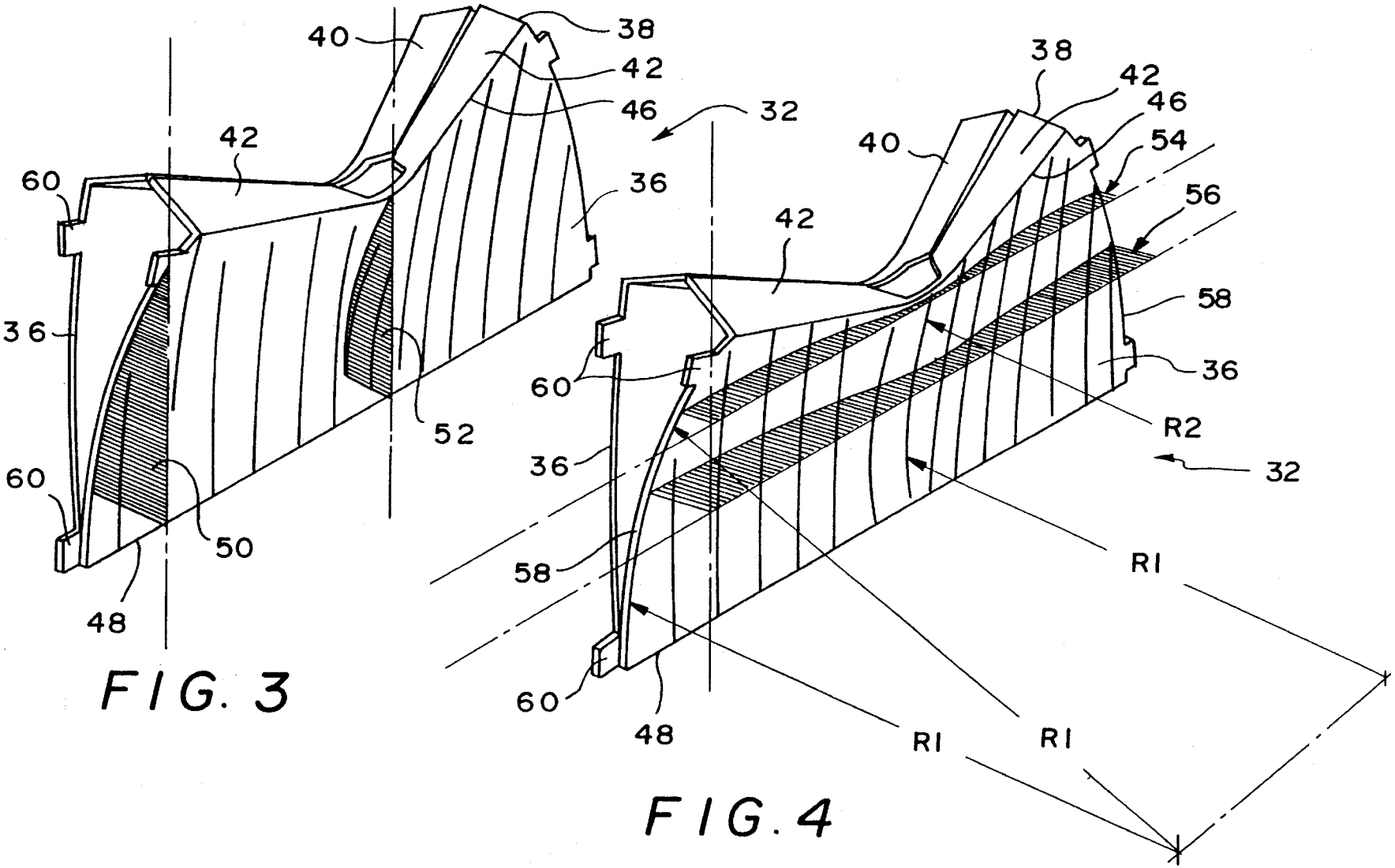
FIG. 3 is perspective view of a cross vane according to the present invention with vertical planes intersecting the cross vane.
FIG. 4 is a perspective view of the cross vane of FIG. 3 with horizontal planes intersecting the cross vane.

A cross vane 32 according to the present invention is shown in FIGS. 3 and 4 and includes two concave reflective surfaces 36 connected to a top surface 38. The top surface 38 of the cross vane has a V-shaped configuration as viewed in a direction parallel to the longitudinal axis of the lamp. The top surface 38 extends from high points at the edges of the cross vane to a low point in the center of the cross vane which accommodates the fluorescent lamp. The V-shaped top surface includes two legs 40,42 of the V which extend downward at an angle from an apex. The legs are inclined at an angle with respect to horizontal when the cross vane is viewed in cross section. Therefore, light which is emitted vertically from the lamp directly to the top surface 38 of the cross vane will be reflected by the angled legs 40,42 at an angle to the vertical rather than being directed back along a vertical path. This prevents multiple reflections which lower the efficiency of the lamp.

The two reflective surfaces 36 of the cross vane 32 extend from the lower edges 46 of the legs 40,42 to a bottom edge 48 at which the reflective surfaces are connected to one another. The reflective surfaces 36 are concavely curved and have a constantly changing cross sectional profile across the width of the cross vane 32 from one side edge 58 to an opposite side edge 58. The cross sectional profile of the cross vane 32 is symmetrical about the vertical center plane 52 of the cross vane. This constantly changing profile is shown by the difference between the two vertical planes 50,52 which intersect the reflective surface 36 along different curved paths as shown in FIG. 3. The curvature of the reflective surfaces 36 changes between the edges of the cross vane and the center of the cross vane. This changing curvature is also shown by the horizontal planes 54,56 which intersect the reflective surface as shown in FIG. 4.

Figure 1:
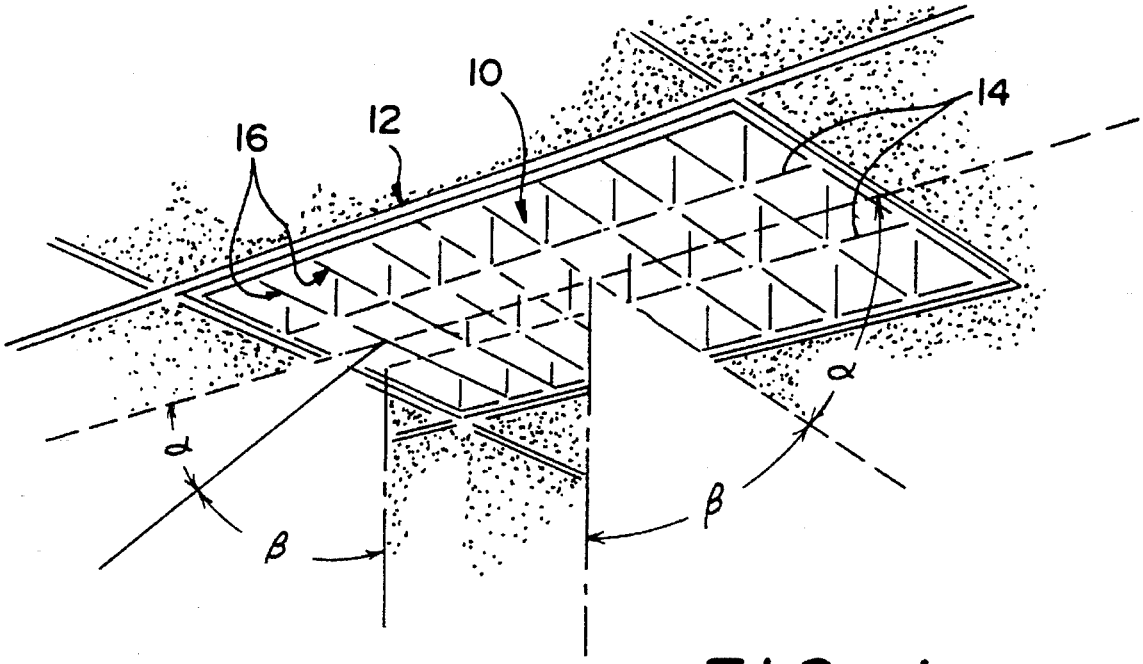
FIG. 1 PRIOR ART
FIG. 1 is a perspective view of a suspended ceiling having a conventional fixture therein.
Figure 2:
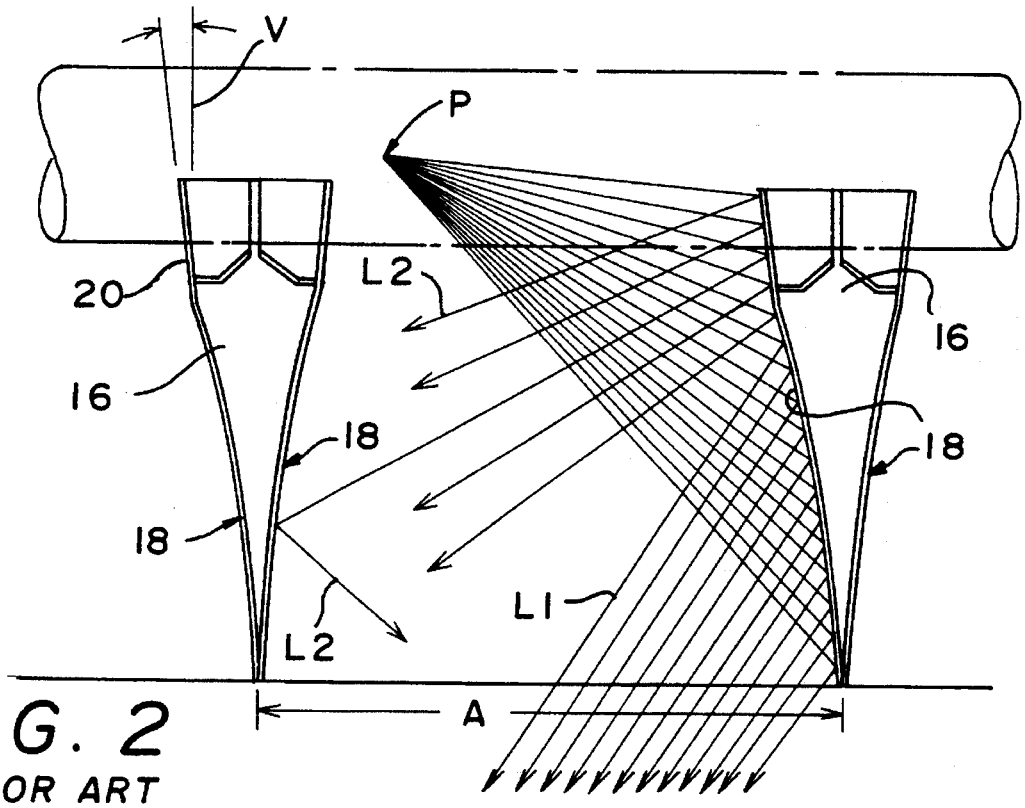
FIG. 2 PRIOR ART
FIG. 2 is a cross sectional view through the cross vanes of the fixture of FIG. 1 taken along a plane perpendicular to cross vanes.

The reflective surfaces 36 at the side edges of the cross vane have a constant radius of curvature R1 as shown by the vertical plane 50 in FIG. 3. The radius of curvature R1 is relatively large, preferably about 7.125 inches. The radius of curvature of the upper portion of the reflective surfaces 36 changes gradually as the distance from the side edges 58 increases until at the center of the cross vane the radius of curvature R2 of the upper portion of the reflective surface is almost half of R1. The radius of curvature of the upper center portion of the reflective surface R2 is preferably about 3.75 inches while the radius of curvature of the lower center portion is preferable the same as the radius of curvature R1 at the edges. The smaller radius of curvature at the upper center portion of the reflective surface creates a greater inclination of the reflective surface with respect to the vertical. This increased inclination causes the emitted light to be directed downward at a steeper angle. In contrast, the more upright upper reflective surface of the prior art, shown in FIG. 2, causes the emitted light from point P to be directed into the adjacent cross vane causing an additional reflection and the inefficiency associated therewith. Therefore, the cross vane of the present invention prevents the additional reflections of the prior art and provides a more efficient fixture.

The cross vane 32 is provided with tabs 60 at each edge of the vane for attaching the vanes to the side reflectors. In addition, the side reflectors 30, shown in FIG. 7, are provided with slots (not shown) which are positioned to accommodate the tabs. The cross vanes are mounted between the side reflectors 30 by inserting the tabs 60 of the cross vanes in the slots of the side reflectors and bending the tabs 60 over to hold the cross vanes in place. Alternative means for attaching the cross vanes 32 to the side reflectors 30 which are known to those in the art may also be used.

The cross vane 32 according to the present invention provides improved efficiency by directing emitted light downwardly into the cut off zone with a minimum number of reflections. The cross vane allows the light to be effectively focused into the cut-off zone to enhance the visual environment and prevent glare.

Figure 5:
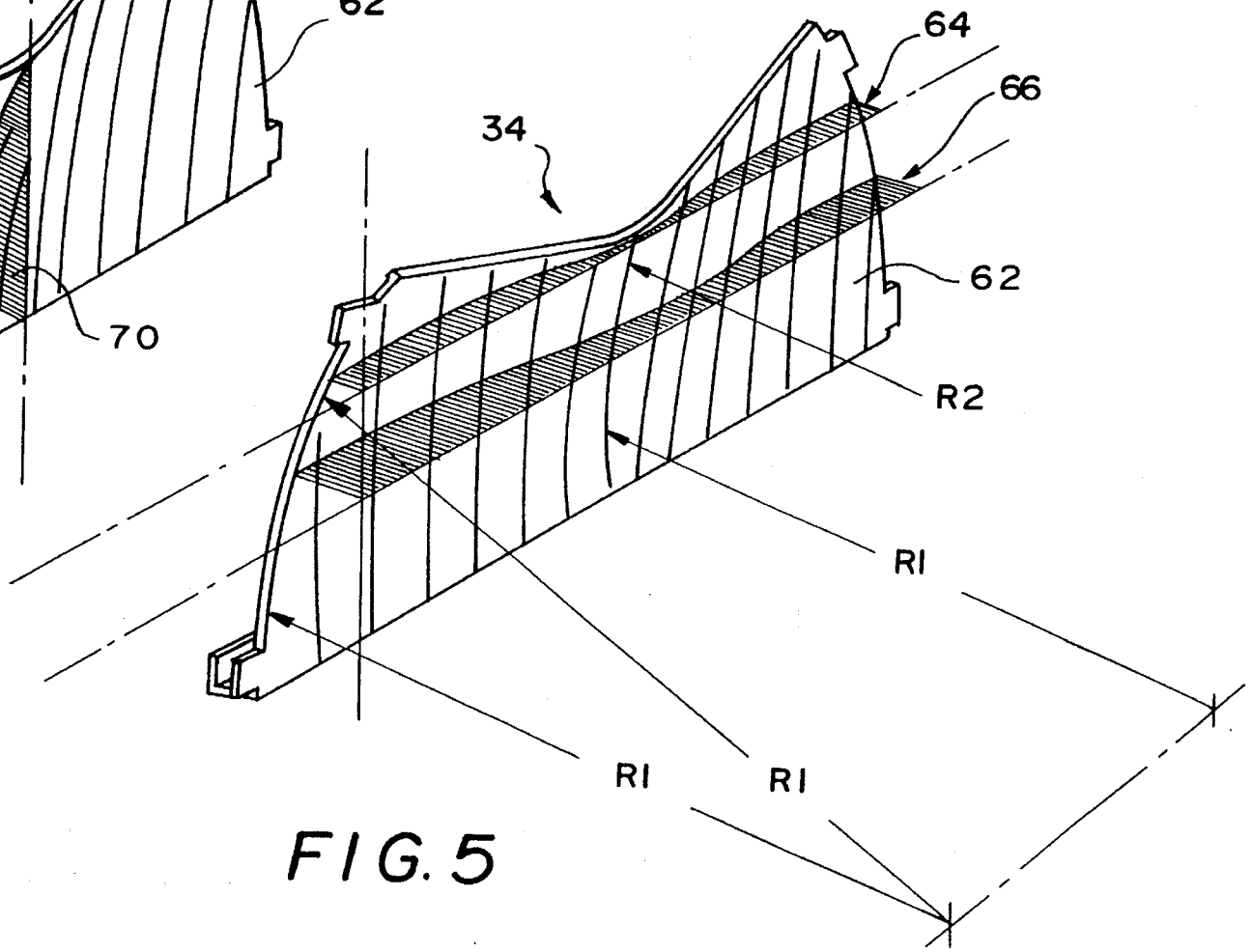
FIG. 5 is a perspective view of an end vane according to the present invention with horizontal planes intersecting the end vane.
Figure 6:
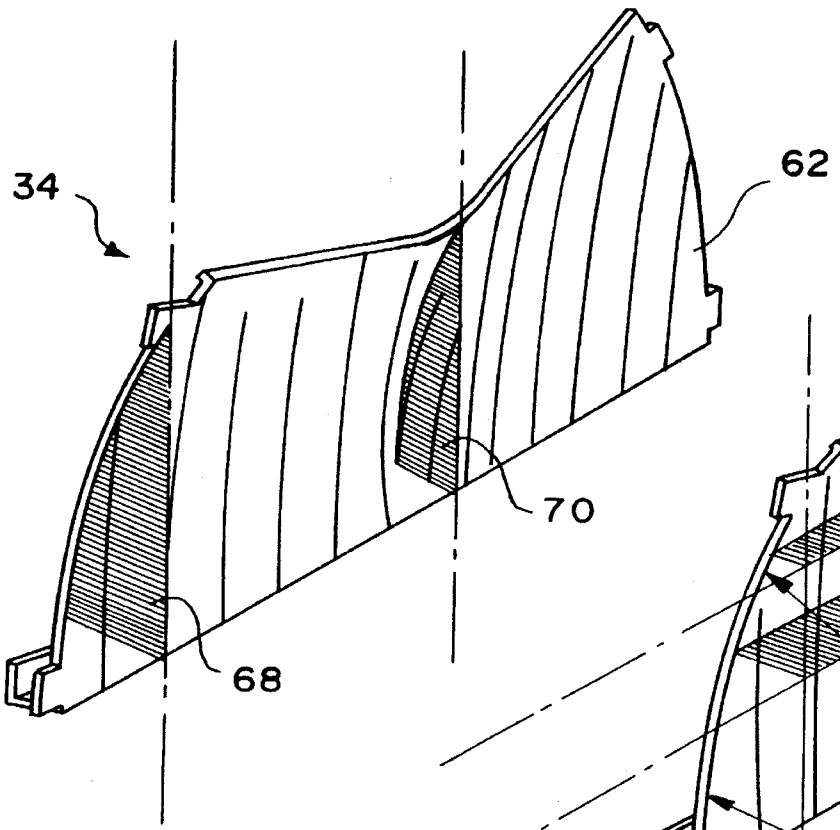
FIG. 6 is a perspective view of the end vane of FIG. 5 with vertical planes intersecting the end vane.

In addition to the cross vanes 32, the louver assembly 28 is also provided with end vanes 34 which are positioned at each end of the louver assembly. An end vane 34 is shown in FIGS. 5 and 6 which has a single concave reflective surface 62 with the same constantly changing curvature as the reflective surfaces 36 of the cross vanes. As shown in FIG. 5, the constantly changing profile is shown by the intersection of the reflective surface 62 with the horizontal planes 64,66. In addition, the profile is shown in FIG. 6 by the intersection of the vertical planes 68,70. The radii of curvature of the reflective surface 62 is large at the edges of the end vane and smaller at the upper center portion of the end vane. The preferred radii of curvature R1 and R2 are the same for the end vane 34 as for the cross vane 32 discussed above.

The cross vane and end vanes are preferably formed of lighting grade prefinished aluminum sheet which has been treated for smoothness. The aluminum sheet is preferably die formed into the configuration shown, however, other materials or methods of manufacture known to those in the art may also be used without departing from the scope of the invention.

While the invention has been described in detail with reference to a preferred embodiment thereof, it will be apparent to one skilled in the art that various changes can be made, and equivalents employed without departing from the spirit and scope of the invention.

What is claimed is:

1. A lighting fixture comprising:

a housing;

means for supporting a fluorescent lamp in said housing, said fluorescent lamp having a longitudinal axis;

side reflectors extending parallel to the longitudinal axis of the lamp along an interior of the housing and positioned on either side of the lamp;

a plurality of cross vanes positioned below and perpendicular to the longitudinal axis of the lamp, each cross vane having a top surface of a generally V-shape, when viewed from a direction parallel to the longitudinal axis of the lamp, and reflector surfaces extending from the top surface, said reflector surfaces being concavely curved wherein a radius of curvature varies along a width of the cross vane.

2. The lighting fixture according to claim 1, wherein the generally V-shaped top surface of the cross vane includes at least two legs extending from an apex of the top surface.

3. The lighting fixture according to claim 1, wherein the reflector surfaces have side edges which abut said side reflectors, the radius of curvature of the reflector surfaces being constant along the side edges.

4. The lighting fixture according to claim 1, wherein the reflector surfaces have a minimum radius of curvature at an upper center portion of the cross vanes.

5. The lighting fixture according to claim 4, wherein the reflector surfaces have a maximum radius of curvature at side edge portions of the cross vanes.

6. The lighting fixture according to claim 5, wherein the reflector surfaces have radii of curvature which constantly vary along the width of the cross vanes.

7. The lighting fixture according to claim 5, wherein the maximum radius of curvature is approximately two times the minimum radius of curvature.

8. The lighting fixture according to claim 1, wherein the cross vanes include means for connecting the cross vanes to the side reflectors in a perpendicular arrangement.

9. The lighting fixture according to claim 1, wherein the side reflectors and cross vanes are removable from the lamp housing.

10. A cross vane for directing light of a fluorescent light fixture comprising:

a top surface of a generally V-shape, when viewed from a direction perpendicular to a width of the cross vane, said V-shape configured to accommodate a fluorescent light tube which extends perpendicular to a width of the cross vane and above the cross vane, said top surface including legs extending from an apex of the top surface;

two reflecting side surfaces, one of said side surfaces extending from a lower edge of each of the legs, the side surfaces being concavely curved along a width of the cross vane and having a radius of curvature which varies along the width of the cross vane; and means for attaching the cross vane to a fluorescent light fixture.

11. The lighting fixture according to claim 10, wherein the generally V-shaped top surface of the cross vane includes at least two legs extending from an apex of the top surface at an angle from one another.

12. The lighting fixture according to claim 10, wherein the reflector surfaces have a minimum radius of curvature at an upper center portion of the cross vane.

13. The lighting fixture according to claim 12, wherein the reflector surfaces have a maximum radius of curvature at side edge portions of the cross vane.

14. The lighting fixture according to claim 10, wherein the reflector surfaces have radii of curvature which constantly vary along the width of the reflector surfaces.

15. The lighting fixture according to claim 13, wherein the maximum radius of curvature is approximately two times the minimum radius of curvature.

16. An end vane for directing light of a fluorescent light fixture comprising:

a top surface of a generally V-shape, when viewed from a direction perpendicular to a width of the cross vane, said V-shape configured to accommodate a fluorescent light tube which extends perpendicular to a width of the end vane;

a reflecting side surface extending from the top surface, the side surface being concavely curved along a width of the end vane and having a radius of curvature which varies along the width of the end vane; and means for attaching the end vane to a fluorescent light fixture.

17. The lighting fixture according to claim 16, wherein the generally V-shaped top surface of the cross vane includes at least two legs extending from an apex of the top surface at an angle from one another.

18. The lighting fixture according to claim 16, wherein the reflecting surface has a minimum radius of curvature at an upper center portion of the end vane.

19. The lighting fixture according to claim 18, wherein the reflector surface has a maximum radius of curvature at side edge portions of the end vane.

20. The lighting fixture according to claim 16, wherein the reflecting surface has a radius of curvature which constantly varies along the width of the reflector surface.

21. The lighting fixture according to claim 19, wherein the maximum radius of curvature is approximately two times the minimum radius of curvature.

* * * * *